US008047868B1

(12) United States Patent
Korczynski

(10) Patent No.: US 8,047,868 B1
(45) Date of Patent: Nov. 1, 2011

(54) STUD-TYPE JUNCTION BLOCK

(75) Inventor: Jacek M. Korczynski, Niles, IL (US)

(73) Assignee: GEP Power Products, Inc., Brookfield, WI (US)

( * ) Notice: Subject to any disclaimer, the term of this patent is extended or adjusted under 35 U.S.C. 154(b) by 0 days.

(21) Appl. No.: 12/414,169

(22) Filed: Mar. 30, 2009

Related U.S. Application Data

(60) Provisional application No. 61/040,343, filed on Mar. 28, 2008.

(51) Int. Cl.
*H01R 13/52* (2006.01)

(52) U.S. Cl. ..... 439/522; 439/801

(58) Field of Classification Search ..... 439/522, 439/755–758, 801, 805, 810
See application file for complete search history.

(56) References Cited

U.S. PATENT DOCUMENTS

| | | | | | |
|---|---|---|---|---|---|
| 2,675,532 | A | * | 4/1954 | Quick | 439/756 |
| 4,118,097 | A | * | 10/1978 | Budnick | 439/387 |
| 4,288,504 | A | | 9/1981 | Julian et al. | |
| 4,410,226 | A | * | 10/1983 | Adduci et al. | 439/142 |
| 4,643,511 | A | * | 2/1987 | Gawlik et al. | 439/755 |
| 4,997,396 | A | * | 3/1991 | Gold et al. | 439/801 |
| 5,013,259 | A | * | 5/1991 | Maurer | 439/522 |
| 5,413,500 | A | * | 5/1995 | Tanaka | 439/521 |
| 5,620,338 | A | * | 4/1997 | Stephens et al. | 439/522 |
| 5,645,457 | A | * | 7/1997 | Hirayama et al. | 439/801 |
| 6,036,517 | A | | 3/2000 | Byrne | |
| 6,045,403 | A | | 4/2000 | Werner et al. | |
| 6,227,914 | B1 | | 5/2001 | Lee et al. | |
| 6,902,434 | B2 | | 6/2005 | Stack | |
| 7,097,486 | B2 | | 8/2006 | Parsons | |
| 7,527,523 | B2 | * | 5/2009 | Yohn et al. | 439/564 |
| 7,611,390 | B2 | * | 11/2009 | Nakazawa | 439/755 |
| 7,641,522 | B2 | * | 1/2010 | Carcangiu et al. | 439/801 |
| 2004/0018417 | A1 | | 1/2004 | Stack | |
| 2006/0164192 | A1 | | 7/2006 | Korczynski | |

* cited by examiner

*Primary Examiner* — Thanh Tam Le
(74) *Attorney, Agent, or Firm* — Boyle Fredrickson, S.C.

(57) ABSTRACT

A stud-type junction block assembly having a mounting member and a body constructed from a highly conductive material. A non-conductive or insulating sheath may be provided over a portion of the body. The body defines a bore configured to receive and retain at least one post constructed from a high-strength material. The bore may include threads for receiving an external threaded surface of the post for securing the post with the bore. In addition, a locking agent or adhesive may be provided to secure the post within the bore. An electrical connector having a ring is coupled to the body over the post to provide an electric path of conduction. A nut or other connector is provided on the post for securing the ring of the electrical connector to the body. A non-conductive cap may be provided over the nut.

23 Claims, 7 Drawing Sheets

STUD-TYPE JUNCTION BLOCK

CROSS REFERENCE TO RELATED APPLICATIONS

The present application claims the benefit of U.S. Ser. No. 61/040,343 filed Mar. 28, 2008, the entire disclosure of which is incorporated herein by reference.

BACKGROUND OF THE INVENTION

The present invention is directed to feed-through and stand-alone type junction blocks that are commonly found in automotive or other applications to connect electrical systems to a power supply or to ground.

Junction blocks are commonly used in construction, military, and other heavy-duty vehicles having multiple electrical systems. Such junction blocks typically include a unitary post and body construction wherein a pair of posts are integrally formed with the body from a single piece of material. Constructions of this type typically result in a great deal of waste as the entire amount of material from the outside of the body to the post must be removed in order to produce the resulting junction block.

Further, such constructions require that the posts and body be formed of the same material. Such a construction is disadvantageous because the body and the posts serve different functions in the junction block assembly. In particular, the conductive material that is desired for use with the body is not optimal for use in the posts. For instance, the body of the junction blocks is preferably constructed from a highly conductive material such as brass. However, highly conductive materials such as brass are not necessarily well suited to function as a strong connection means, e.g. a threaded connection. As such, junction blocks of the prior art made from brass typically require relatively long threaded posts and mating nuts, due to the brittleness of brass, which provides a greater surface area contact of nuts on the posts.

Thus, a junction block assembly that reduces waste and provides a high conductive assembly while maintaining a relatively robust construction is desired.

SUMMARY OF THE INVENTION

The junction block assembly according to the present invention includes a mounting member and a body supported by the mounting member. A bore is defined within the body. A post, which is separate from the body and inserted through the bore to couple the post to the body, is adapted to receive an electrical member. A connector engageable with the post is provided to secure the electrical member against the body.

The junction block assembly of the present invention may include a cap assembly having a loop portion that is inserted onto the post prior to the connector being fit over the post to thereby retain the cap assembly with the mounting member. The junction block may also have a cap portion connected to the loop portion that fits over the connector once the connector has been fit over the post.

In addition, the bore of the junction block may be defined by a threaded surface formed in the body. The post may thus include a threaded exterior surface such that the post is threaded into the bore to couple the post to the body.

In one embodiment, the bore generally includes a first end defined at a first surface of the body and a second end aligned with the first end defined at a second surface of the body. Each of the ends of the bore may be configured to receive a post therethrough. The posts extend into the bore, and the inner ends of the posts preferably come into contact with each other in a central area of the body.

The body may be formed of a first conductive material and the post may be formed from a second material, which is different than the first conductive material. For instance, the first conductive material may be brass and the second material may be steel.

A bonding agent may be provided for interconnecting an exterior surface of the post with an interior surface of the body defining a portion of the bore.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
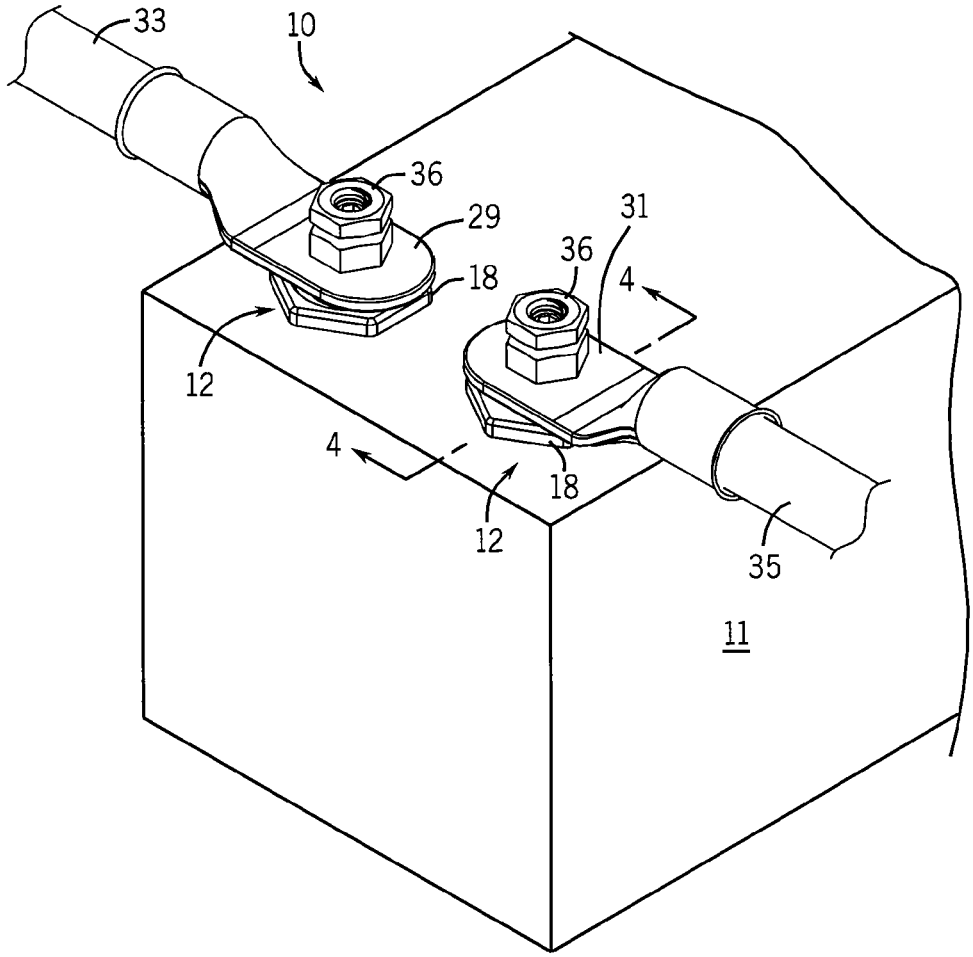
FIG. 1 is a partial isometric view of a system including a junction block assembly according to the present invention.
Figure 2:
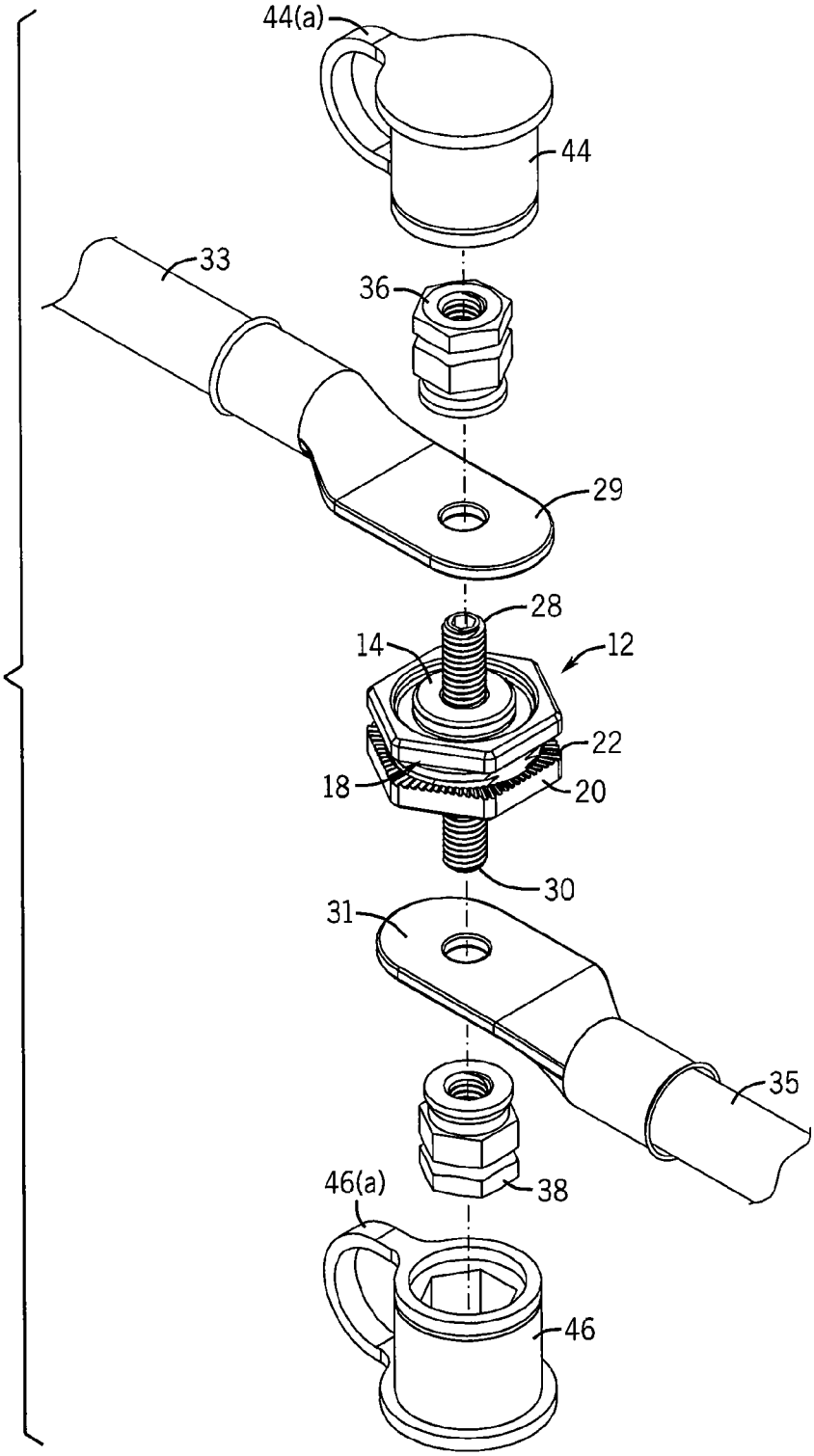
FIG. 2 is a partially exploded isometric view of the junction block assembly of the present invention.
Figure 3:
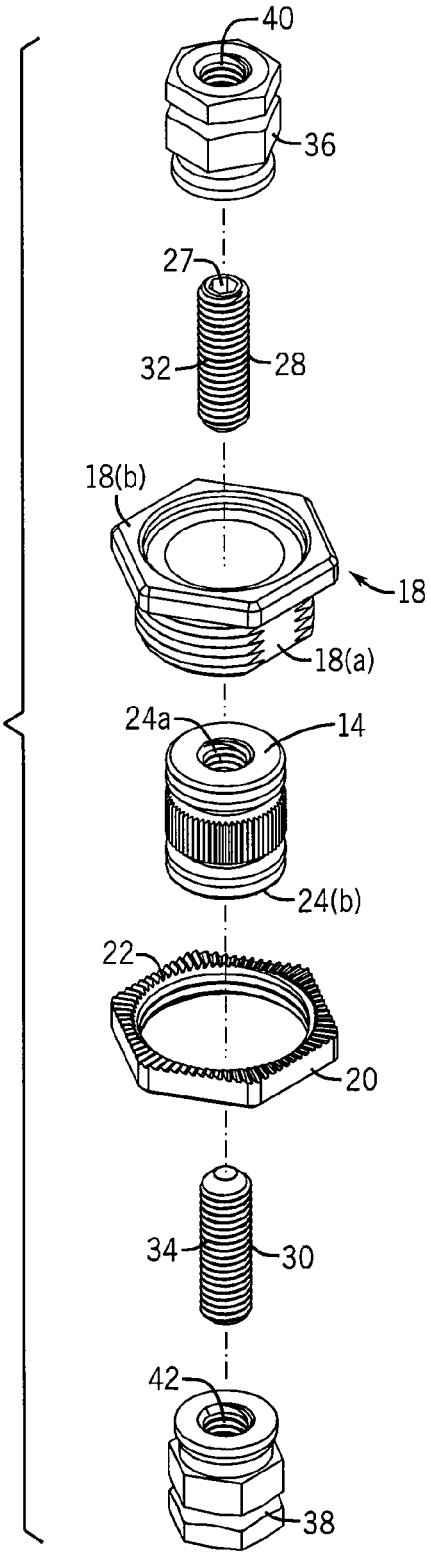
FIG. 3 is an exploded isometric view of the junction block assembly of the present invention.
Figure 4:
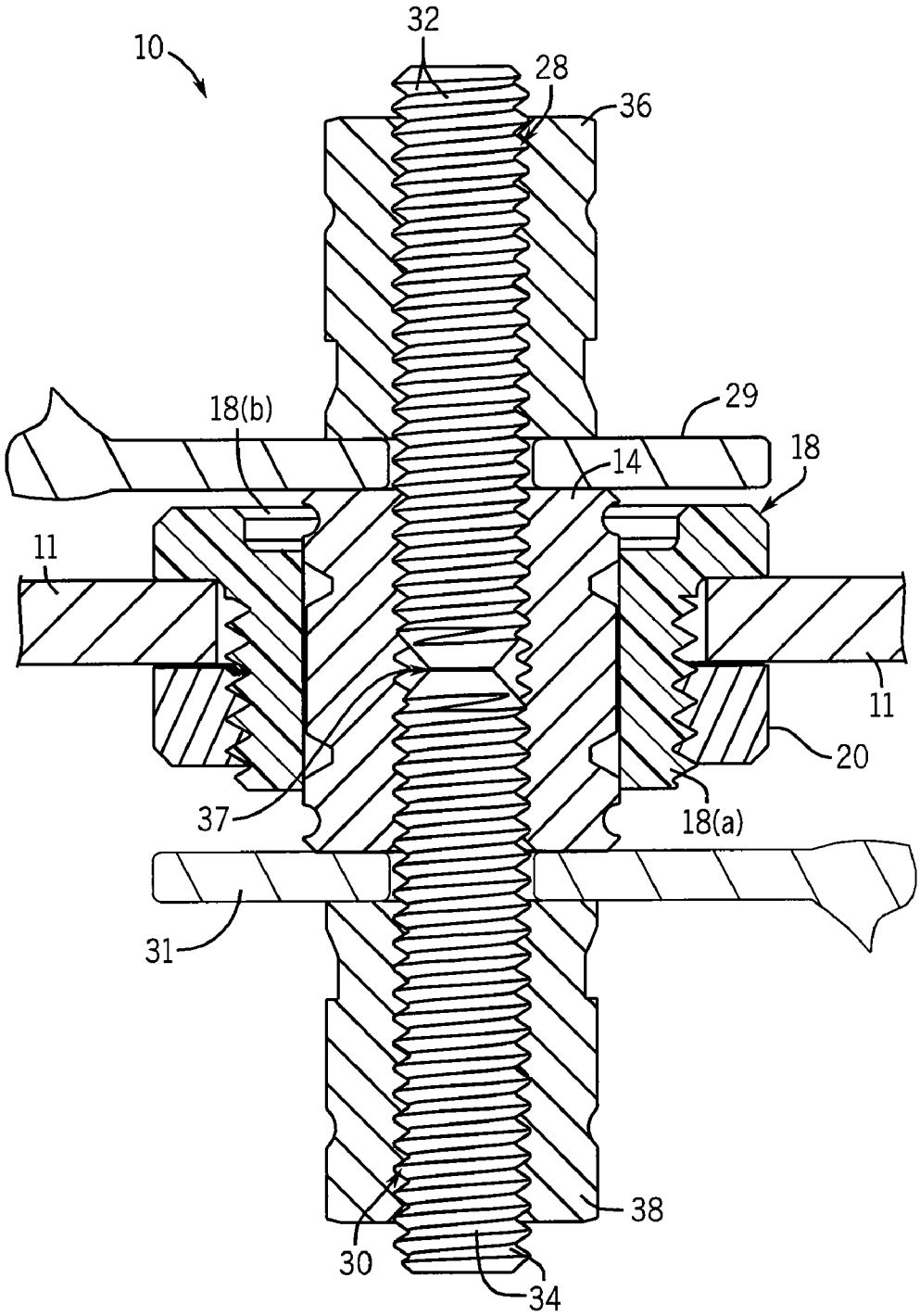
FIG. 4 is a cross-section through the junction block assembly of the present invention taken along line 4-4 of FIG. 1.

Referring now to the drawings, and initially to FIGS. 1-4, a representative embodiment of the feed-through junction block assembly 10 of the present invention is shown secured to a wall 11. The wall 11 may be a part of a housing or any other structure in which it is desired to pass electrical power from one side of the wall 11 to the other. Representatively, the wall 11 may be associated with a battery housing in a vehicle, although it is understood that the wall 11 may be a part of any other structure, such as in a home, building, power plant, etc.

Junction assembly 10 includes a mounting member 12 having a body 14 that includes a shoulder, which are formed as a single unitary body in a known manner, and a sleeve 18. The body 14 is formed as a single unitary body comprised of a highly electrically conductive material, such as copper or brass. The body 14 has a diameter generally less than that of the shoulder. The shoulder and the body 14 are contained within a sleeve 18 of insulating material. The sleeve 18 includes a cylindrical portion 18(*a*) within which the majority of the length of the body 14 is received, and which has a threaded exterior. The sleeve 18 also includes an end portion 18(*b*) that surrounds the shoulder. The end portion 18(*b*) has a generally hexagonal shape with a smooth exterior (although it is understood that any other satisfactory shape may be employed).

The cylindrical portion 18(*a*), and thus the body 14, is designed to pass through an opening (not shown) formed in wall 11. The width of the end portion 18(*b*) is greater than the diameter of the opening so that the end portion 18(*b*) can be held tightly against wall 11. The cylindrical portion 18(*a*) has a length sufficient to extend through the thickness of a wall of 11, such that the end of the cylindrical portion 18(*a*) opposite end portion 18(*b*) is exposed.

A retaining ring 20 may be threaded over the cylindrical portion 18(*a*) of the sleeve 18 to retain the mounting member 12 against the wall. More particularly, after the cylindrical portion 18(*a*) is passed through the opening, the inside surface of the end portion 18(*b*) is held against the opposing surface of the wall 11. The retaining ring 20 may then be rotated up the threads of the cylindrical portion 18(*a*) toward the wall 11. Once tightened, the retaining ring 20 will press tightly up against the wall 11 to clamp the wall between the ring 20 and the end portion 18(*a*). It is contemplated that retaining ring 20 may be either plastic or similar insulating material, or may be composed of a metal such as steel. In one embodiment, the retaining ring 20 includes teeth 22 that "grab" the wall 11 when the ring 20 is tightened, to prevent the retaining ring 20 from backing away from the wall of 11. The retaining ring 20 may be formed of a metal or plastic material, or any other satisfactory material as desired.

A bore 24 extends centrally through the body 14. In one embodiment, the bore 24 is machined to define threads 26. The bore 24 is open at both of its ends 24(*a*), 24(*b*) so that a stud or post may be threadingly secured to the mounting member 12. More particularly, a pair of posts 28 and 30 are adapted for engagement within bore 24. The posts 28 and 30 include threaded exterior surfaces 32 and 34, respectively. Post 28 is turned into bore 24 at end 24(*a*) whereas post 30 is turned into bore 24 at end 24(*b*). The posts 28, 30 are formed of a high-strength material that is well-suited for use as a connector, and representatively may be made of steel or similar material in contrast to the copper or brass used to form the body 14. The posts 28, 30 are preferably advanced so that the inner ends of the posts 28, 30 are moved into contact with each other. A suitable locking agent 37, such as Loctite®, is applied to the end of the posts 28, 30 so that, when the end of the posts 28, 30 are moved into contact with each other, the inner ends of the posts 28, 30 adhere together so that the posts 28, 30 cannot be removed from the bore 24. Alternatively, it is understood that a bore may be formed so as to extend inwardly from each end of the body 14, without the bore extending completely through the body. In this version, the posts 28, 30 are threaded into the separate bores, and are moved into contact with the body 14 at the inner end of the bore. Again, a suitable locking agent may be applied so as to prevent the posts from being removed from the bores. Each of the posts 28, 30 may be formed with a recess, such as shown at 27, which extends inwardly from its outer end. The recess 27 functions as a driving socket, and is configured to receive a driver so as to enable the posts 28, 30 to be advanced into the bore 24. Representatively, the recess 27 may have a non-circular shape, such as a hex shape, to receive a driver such as an Allen wrench, although it is understood that any other satisfactory socket and driver combination may be employed. Alternatively, the end of the post may have an extension that defines a non-circular cross section, which may be engaged by a wrench in order to advance the post into the bore.

The rings 29 and 31 of a pair of electrical connectors 33 and 35 may be fitted over respective ones of the posts 28 and 30, to provide an electrical interconnection from one post to the other post through the body 14 and the shoulder 16. The rings 29, 31 may be secured using nuts 36 and 38. The nuts 36, 38 have threaded interiors 40, 42, respectively, that allow the nuts 36, 38 to be threaded onto the posts 26, 28 and 30, respectively, and to tighten the rings 29, 31 against the body 14 and the shoulder 16. In one representative embodiment, insulating caps 44 and 46 may be secured over the nuts 36 and 38, respectively. The insulating caps 44, 46 may also have a color to provide a visual identifier as to what electrical connection is being made at the junction block assembly 10. The insulating caps 44 and 46 may include a loop portions 44(*a*) and 46(*a*), respectively, that are slid onto the respective posts 28 and 30, before the nuts 36 and 38 are threaded onto the posts, 28 and 30, respectively. The nuts 36, 38 therefore also secure the insulating caps 44, 46 to junction block assembly 10.

It can thus be appreciated that the junction block assembly 10 as shown and described provides posts 28, 30 that are separate from the body 14. This is in contrast to the prior art construction, which contemplates a unitary post and body construction in which both the posts and the body are formed from a single piece of material that is turned and machined so that the posts and body are integral. This prior art construction provides a great deal of waste, in that the entire amount of material from the outside of the body to the post must be removed in order to produce the junction block. In addition, forming the posts of the same material as the body is disadvantageous, in that the conductive material that is desirable for the body is not necessarily desirable for the posts, and vice versa. That is, with the present invention, the posts can be formed of a high-strength material such as steel while the body can be formed of a highly conductive material such as copper or brass. The conductive material of the prior art, such as brass, results in relatively long posts since the brittleness of brass requires more surface area contact of the nuts on the posts. In contrast, the junction block of the present invention has a conductive block body, such as copper or brass, but steel or similar metal posts. Steel is stronger than brass and therefore the length of the steel posts may be shorter than conventional brass posts.

Figure 5:
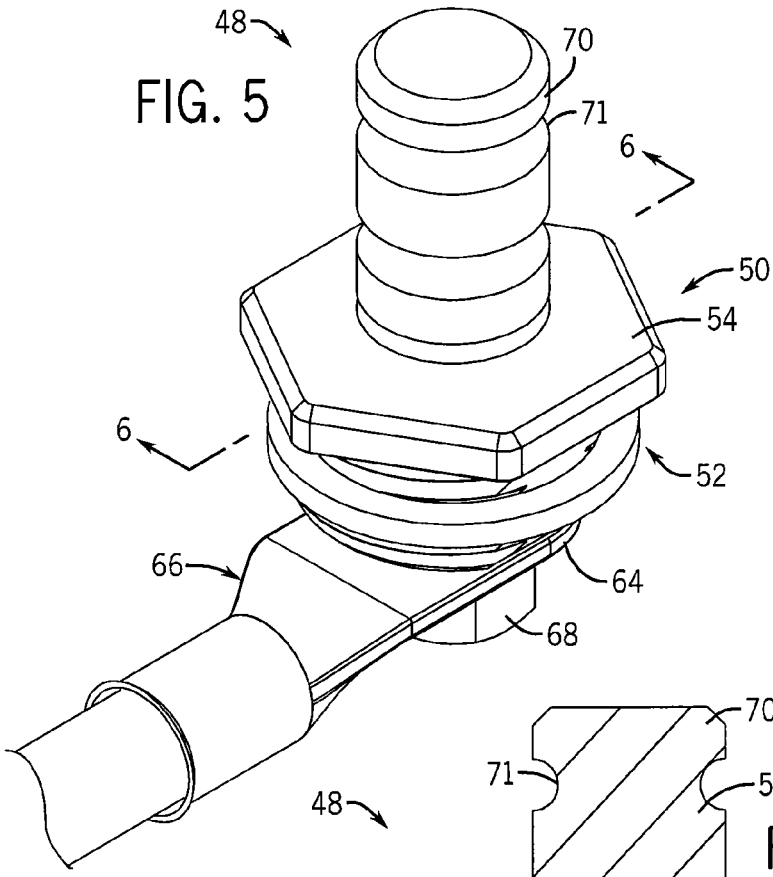
FIG. 5 is an isometric view of an alternative construction of the junction block assembly of the present invention.
Figure 6:
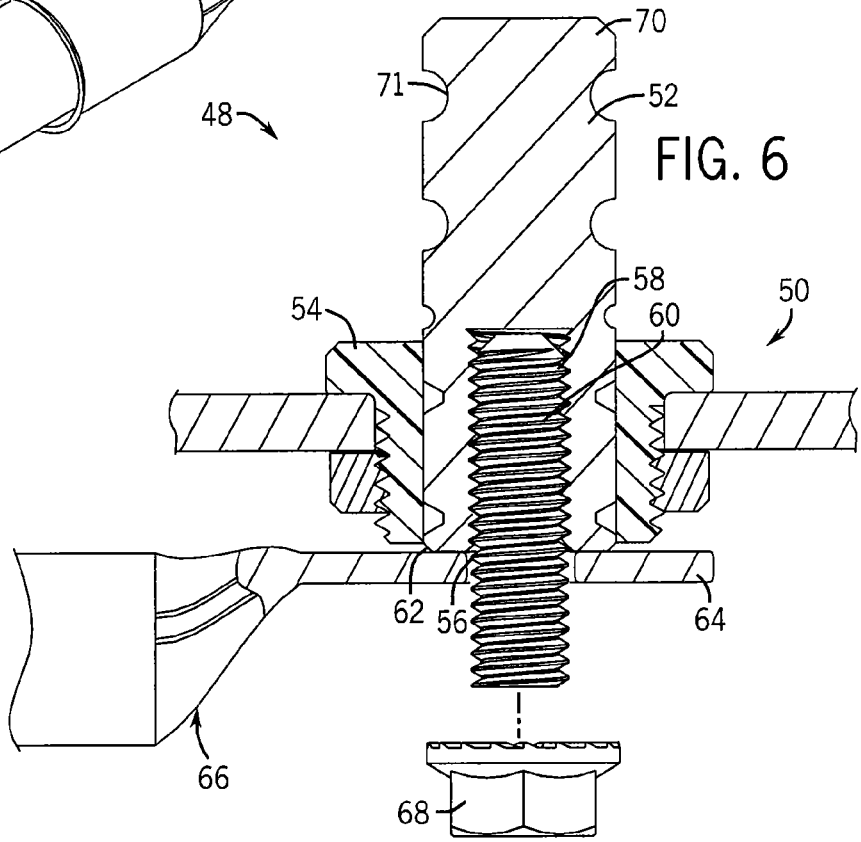
FIG. 6 is a cross-section through the junction block assembly of the present invention taken along line 6-6 of FIG. 5.

FIGS. 5-6 illustrate an alternative embodiment of the present invention including a junction block assembly 48 having a mounting member 50 including a body 52 formed of highly conductive copper or brass or similar material and contained within a non-conductive sheath 54. The sheath 54 is constructed similarly to sleeve 18 of the previous embodiment, though other constructions are contemplated. The sheath 54 may include a portion that covers the exterior of the body 52, or alternatively, a portion of the exterior surface of the body 52 may remain uncovered.

The body 52 is machined to define a bore 56 that is open at one end and closed at the opposite end. In one representative embodiment, the bore 56 is threaded to receive a post 58 having a threaded exterior surface 60. Again, the post 58 may be composed of a material other than the material of body 52, such as high-strength steel. A face 62 of body 52 provides a seat for one or more rings 64 of a corresponding electrical connector 66 such as a cable that may be slid over post 58. The ring 64 is secured against the face 62 by a nut 68 threaded onto the post 58. An insulating cap, such as those described herein, may additionally be used to cover nut 68.

A stud 70 is formed as part of the body 52, extending in a direction opposite post 58. In operation, stud 70 may be used as an electrical connection point in, for example, an automotive application in which a battery is connected to one side of junction block 48 using nut 68 and stud 70 is adapted to be engaged by an alligator clamp of a jumper cable. Stud 70 may include a number of grooves 71 around a circumference thereof for facilitating connection with the leads of the jumper cables or other electrical connector.

Figure 7:
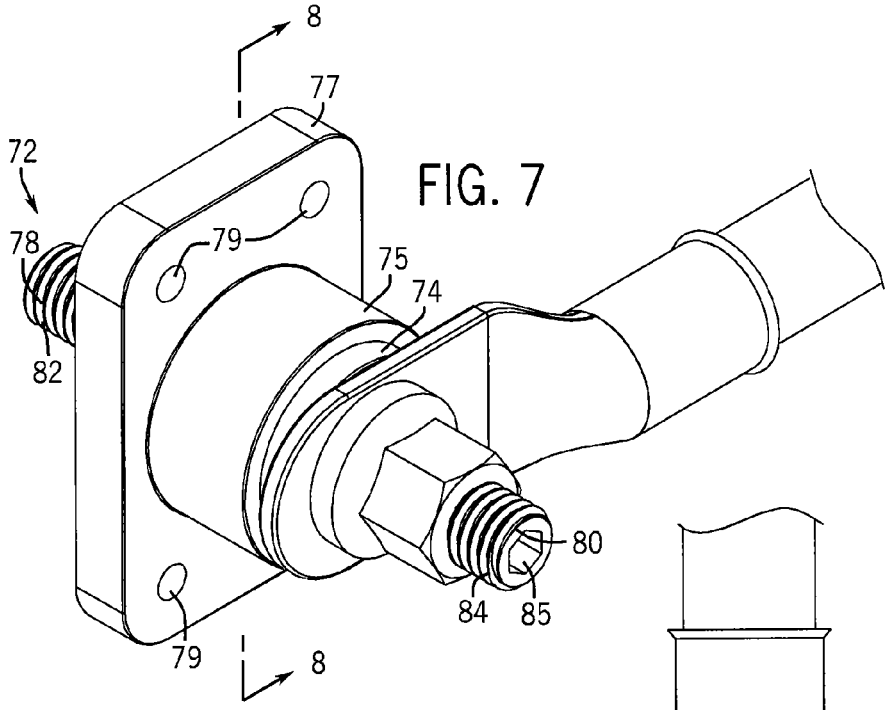
FIG. 7 is an isometric view of an alternative embodiment of a junction block assembly according to the present invention.
Figure 8:
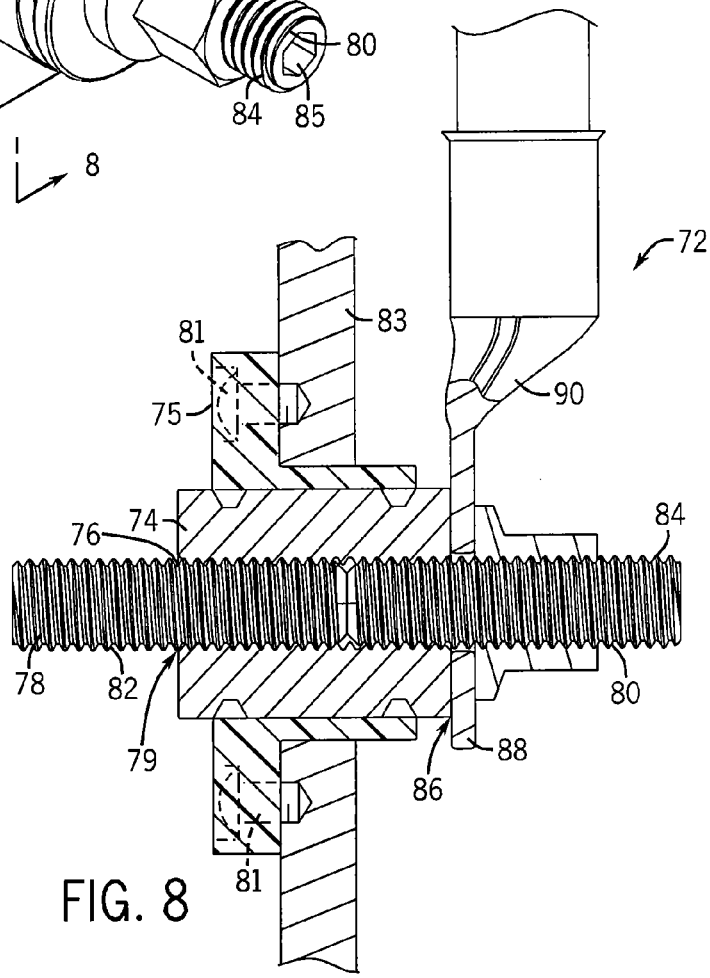
FIG. 8 is a cross-section of the junction block assembly of the present invention taken along line 8-8 of FIG. 7.

Turning now to FIGS. 7 and 8, another embodiment of a junction block 72 according to the present invention is shown. The construction of junction block 72 is substantially similar to that of the previous embodiments. The embodiment illustrated in FIGS. 7 and 8 includes a generally cylindrical body 74 defining a bore 76 for receiving a pair of posts 78, 80. The cylindrical body 74 is constructed from a highly conductive material such as copper or brass and is housed within a non-conductive sheath 75. In one embodiment, a portion of the cylindrical body 74 remains uncovered by the sheath 75. Sheath 75 includes a generally planar base 77 having a series of mounting holes 79 for surface mounting the junction block 72 assembly within an automobile or other such similar application. A number of corresponding fasteners 81 such as screws or bolts may be inserted through mounting holes 79 and into a surface 83 for securing junction block 72 thereto.

Bore 76 extends along the length of the cylindrical body 74 to receive the posts 78, 80 therein. Bore 76 may be threaded to cooperate with threaded surfaces 82, 84 of posts 78, 80 respectively. As in the previously-described embodiments, posts 78, 80 are preferably constructed from a relatively high-strength metal such as steel. Also as in the previous embodiments, posts 78, 80 may be retained within bore 76 by way of an adhesive or locking agent 79. Posts 78, 80 each include a recess 85 in an outer end thereof for receiving a tool. Recess 85 may be generally cylindrical or hexagonal or any other such shape capable of receiving a tool for driving the post into and out of the bore 76 and into electrical communication with the other of the pair of posts 78, 80.

A face 86 of cylindrical body 74 provides a seat for one or more rings 88 for coupling an electrical connector 90 to the cylindrical body 74. A nut like those described above may be threaded onto each of the ends of posts 78, 80 to secure rings 88 in place. Likewise, an insulating cap, such as those described previously, may be placed over an end of the nuts.

Figure 9:
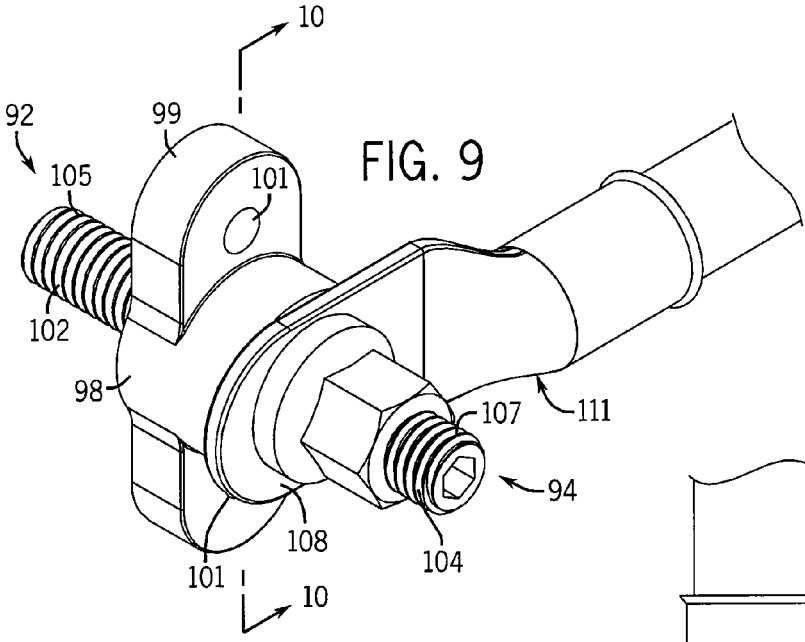
FIG. 9 is an isometric view of an alternative embodiment of a junction block assembly according to the present invention.
Figure 10:
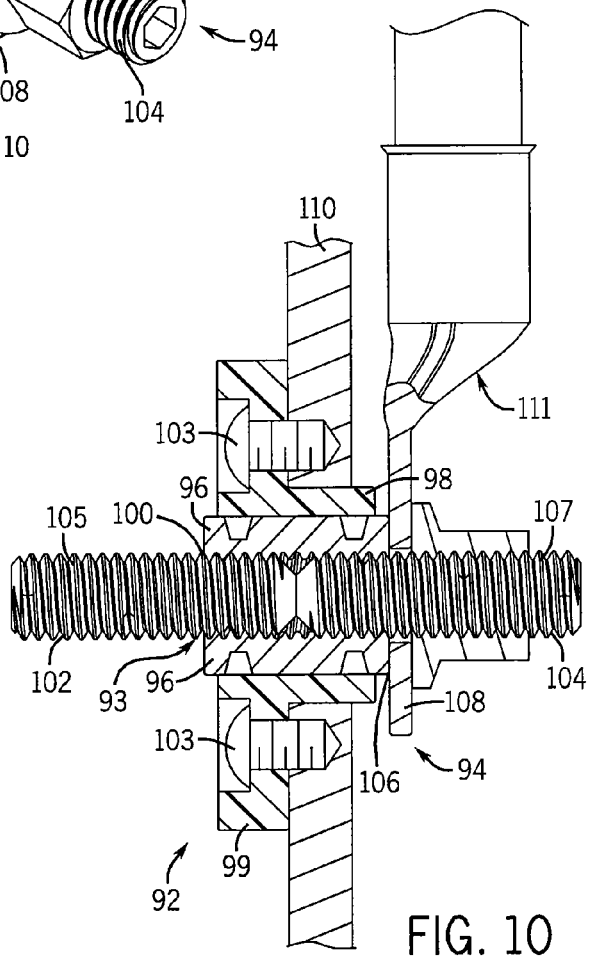
FIG. 10 is a cross-section of the junction block assembly of the present invention taken along line 10-10 of FIG. 9.

Turning now to FIGS. 9-10, another embodiment of a junction block 92 according to the present invention is illustrated. Junction block 92 includes a mounting member 94 defining a body 96 preferably constructed from a highly conductive material such as copper or brass. A non-conductive sheath 98 is provided over at least a portion of the body 96 of junction block 92. Sheath 98 defines a generally oval base 99 including a pair of mounting holes 101 configured to receive screws 103 or similar such fasteners for mounting junction block 92 to a surface 110, such as within an automobile or similar such apparatus or structure. Body 96 defines a bore 100 through a length thereof. Bore 100 is configured to receive a pair of posts 102, 104 preferably constructed from a relatively high-strength material such as, for example, steel. Posts 102, 104 may be secured within bore 100 by way of a locking agent 93, adhesive, or similar such compound. Posts 102, 104 each include a threaded outer surface 105, 107 respectively for threadingly coupling to an internal threaded surface of bore 100 to thereby secure posts 102, 104 therein.

Body 96 defines a generally circular face 106 configured to receive a ring 108 of an electrical connector 111 as in the previously-described embodiments of the present invention. Likewise, junction block 92 may further include a pair of nuts (not shown) like those of the previous embodiments for securing rings 108 thereto. Again, a non-conductive cap may be provided over each of the nuts.

While the posts and bores have been described as having complimentary threads for coupling the posts to the bodies, it is understood that other types of locking configurations may be used, such as twist-locks.

Although the best mode contemplated by the inventor of carrying out the present invention is disclosed above, practice of the present invention is not limited thereto. It is further contemplated that various additions, modifications and rearrangements of the features of the present invention may be made without deviating from the spirit and scope of the underlying inventive concept.

I claim:

1. A stud-type junction assembly comprising:

a mounting member configured for engagement with a support structure;

an electrically conductive body carried by the mounting member, wherein the electrically conductive body defines first and second exposed oppositely facing conductor engagement surfaces and a threaded passage that extends through the electrically conductive body and opens onto the first and second conductor engagement surfaces;

a threaded post that is separate from the body and that is coupled to the electrically conductive body via engagement of the threaded post within the threaded passage of the electrically conductive body, wherein the threaded post defines a first threaded end portion that extends outwardly from the first exposed conductor engagement surface and a second threaded end portion that extends outwardly from the second exposed conductor engagement surface; and first and second threaded connectors configured for movable threaded engagement with the first and second threaded end portions of the post, respectively, wherein the first and second threaded connectors are movable on the respective first and second threaded end portions toward and away from the first and second conductor engagement surface of the body, respectively, wherein movement of the first and second connectors toward the first and second conductor engagement surfaces, respectively, is operable to sandwich first and second electrical conductors between the first and second connectors and the first and second conductor engagement surfaces, respectively.

2. The junction assembly of claim 1 wherein the threaded post comprises a pair of post sections engaged within the threaded passage, wherein a first one of the post sections extends outwardly from the first conductor engagement surface and defines the first threaded end portion, a second one of the post sections extends outwardly from the second conductor engagement surface and defines the second threaded end portion.

3. The junction assembly of claim 1 wherein the electrically conductive body is formed of a first conductive material and the post is formed of a second material different from the first conductive material.

4. The junction assembly of claim 3 wherein the first conductive material is copper or brass and the second material is steel.

5. The junction assembly of claim 1 further comprising a bonding agent interconnected between the post and the body.

6. The junction assembly of claim 1, wherein the post defines an outer end that includes a recess, and wherein the recess is configured as a driving socket for receiving a driver to enable rotation of the post relative to the electrically conductive body.

7. The junction assembly of claim 1, wherein each electrical conductor includes a ring adapted to be sandwiched between one of the conductor engagement surfaces of the electrically conductive body and one of the connectors to provide a path of electrical conduction between the electrically conductive body and the electrical conductor.

8. The junction assembly of claim 1, wherein each connector comprises an internally threaded nut configured for engagement with the threads on one of the end portions of the post for sandwiching the electrical conductor between the connector and the conductor engagement surface.

9. The junction assembly of claim 8 further comprising a cap assembly having a loop portion that is inserted onto the first end portion of the post before the nut is engaged with the first end portion of the post to retain the cap assembly, and further having a cap portion connected to the loop portion that fits over the nut.

10. The junction assembly of claim 1, wherein the mounting member comprises a non-conductive sheath within which the electrically conductive body is positioned.

11. The junction assembly of claim 10, wherein the sheath includes a base having one or more mounting holes for receiving fasteners to secure the junction assembly to the support structure.

12. A junction block kit comprising:

a mounting member configured for engagement with a support structure, wherein the mounting member defines an internal cavity;

an electrically conductive member at least partly contained within the internal cavity of the mounting member and having a threaded bore extending therethrough, wherein the threaded bore opens onto each of a pair of conductor engagement surfaces defined by the electrically conductive member;

a threaded post separate from the electrically conductive member and threadedly engaged within the bore, wherein the post defines a first threaded end portion that extends outwardly from a first one of the conductor engagement surfaces and a second threaded end portion that extends outwardly from a second one of the conductor engagement surface; and first and second threaded connectors configured for movable threaded engagement with the first and second threaded end portions of the post, respectively, wherein each connector is movable on the respective end portion toward and away from the respective conductor engagement surface, wherein movement of the each connector toward the respective conductor engagement surface is operable to sandwich an electrical conductor between the respective connector and the respective conductor engagement surface.

13. The kit of claim 12 wherein the post comprises first and second post sections, wherein the first post section is adapted to be inserted into the bore at the first conductor engagement surface and the second post section is adapted to be inserted into the bore at the second conductor engagement surface, and wherein the post sections define inner ends that engage each other within the passage.

14. A junction block kit comprising:

a sleeve configured to engage a support structure, wherein the sleeve has a first bore extending therethrough;

an electrically conductive member at least partly contained within the first bore, the electrically conductive member having a first end, a second end, and a second bore extending therethrough from the first end to the second end;

a first post configured to be received within the second bore at the first end and coupled to the electrically conductive member;

a second post configured to be received within the second bore at the second end and coupled to the electrically conductive member;

a first connector engageable with the first post and adapted to secure a first electrical member on the first post and against the electrically conductive member; and a second connector engageable with the second post and adapted to secure a second electrical member on the second post and against the electrically conductive member.

15. The kit of claim 14 wherein the electrically conductive member is composed of a highly conductive material and the first post and the second post are each composed of a high-strength metallic material.

16. A method of making a junction block assembly comprising the steps of:

providing an electrically conductive body having first and second oppositely facing conductor engagement surfaces and a threaded passage that extends inwardly from the conductor engagement surfaces;

positioning the electrically conductive body within an internal cavity defined by a mounting member such that the electrically conductive body is carried by the mounting member and the first and second conductor engagement surfaces are exposed, wherein the mounting member is configured for engagement with a support structure;

threadedly engaging a threaded post with the threaded passage of the electrically conductive body such that a first threaded outer portion of the post extends outwardly from the first exposed conductor engagement surface of the body and a second threaded outer portion of the post extends outwardly from the second exposed conductor engagement surface of the body; and providing first and second threaded connectors that are movably engageable with the first and second threaded outer portions of the posts, respectively, wherein the first threaded connector is movable on the first threaded outer portion of the post toward and away from the first conductor engagement surface and the second threaded connector is movable on the second threaded outer portion of the post toward and away from the second conductor engagement surface, wherein movement of the first and second connectors on the respective first and second outer portions of the posts is operable to sandwich respective first and second electrical conductors between the connector and the respective conductor engagement surface of the body.

17. The method of claim 16, further comprising the step of applying a locking agent to the post to secure the post to the body.

18. The method of claim 16, wherein the step of threadedly engaging a threaded post with the threaded passage is carried out by engaging a first threaded post section within the passage from the first conductor engagement surface and engaging a second threaded post section within the passage from the second conductor engagement surface, and engaging the first and second post sections with each other within the threaded passage.

19. The method of claim 16, wherein the body is constructed of a highly conductive material.

20. The method of claim 19, wherein the post is constructed of a material different than the highly conductive material.

21. The method of claim 16, further comprising the step of capping one of the connectors with a non-conductive member.

22. A junction block kit comprising:

a mounting member configured to engage a support structure, wherein the mounting member has a passage extending therethrough;

an electrically conductive member at least partly contained within the passage, the electrically conductive member having a first end, a second end, and a threaded bore extending therethrough from the first end to the second end;

a first threaded post received within the threaded bore at the first end;

a second threaded post received within the threaded bore at the second end;

a first threaded connector engageable with the first post and adapted to secure a first electrical member on the first post and against the electrically conductive member; and a second connector engageable with the second post and adapted to secure a second electrical member on the second post and against the electrically conductive member.

23. The junction block kit of claim 22, wherein the first and second posts define inner ends that engage each other within the threaded bore of the electrically conductive member.

* * * * *